US005338712A

United States Patent [19]

MacMillan et al.

[11] Patent Number: 5,338,712

[45] Date of Patent: Aug. 16, 1994

[54] PRODUCTION OF NON-EXPLOSIVE FINE METALLIC POWDERS

[75] Inventors: John P. MacMillan, Renfrew; Douglas J. Zuliani, Stittsville; Martin J. Bray, Renfrew, all of Canada

[73] Assignee: Timmino Ltd., Toronto, Canada

[21] Appl. No.: 13,347

[22] Filed: Feb. 4, 1993

[51] Int. Cl.[5] ..... C04B 35/02

[52] U.S. Cl. ..... 501/94; 75/354; 149/110; 501/100; 501/108

[58] Field of Search ..... 75/232, 233, 234, 235, 75/249, 252, 354, 243; 501/94, 100, 108, 127, 133; 149/110, 124

[56] References Cited

U.S. PATENT DOCUMENTS

| | | | |
|---|---|---|---|
| 3,322,551 | 5/1967 | Bowman | 106/58 |
| 3,890,166 | 6/1975 | Kondis . | |
| 4,069,060 | 1/1978 | Hayashi et al. | 106/65 |
| 4,078,599 | 3/1978 | Makiguchi et al. | 164/41 |
| 4,222,782 | 9/1980 | Alliegro | 106/57 |
| 4,243,621 | 1/1981 | Mori et al. | 264/65 |
| 4,280,844 | 7/1981 | Shikano et al. | 106/56 |
| 4,306,030 | 12/1981 | Watanabe et al. | 501/99 |
| 4,460,528 | 7/1984 | Petrak et al. | 264/65 |
| 4,557,884 | 12/1985 | Petrak et al. | 264/65 |

FOREIGN PATENT DOCUMENTS 2209345A 5/1989 United Kingdom .

OTHER PUBLICATIONS

Paper "Explosibility of Metal Powders" by Murray Jacobson, Austin R. Cooper, and John Nagy; (pp. 7 and 8), Mar. 1964.

U.S. Dept. of the Interior; Bureau of Mines, Oct. 1943 Report of Investigations, "Inflammability and Explosibility of Metal Powders" by Irving Hartmann, John Nagy and Hylton R. Brown, (pp. 27 and 28), Oct. 1943.

Database WPI. Derwent Publications Ltd., London, GB, AN 80-03355c & SU, A, 659 601 (Alum Magn electr Ind) May 29, 1979. See abstract.

Patent Abstracts of Japan, vol. 12 No. 332 (M-738) Sep. 1988, & JP S, 63 096 201 (Kurosaki Refract Co. Ltd.) Apr. 27, 1988.

*Primary Examiner*—Mark L. Bell
*Assistant Examiner*—Paul Marcantoni
*Attorney, Agent, or Firm*—Nixon & Vanderhye

[57] ABSTRACT

A process for producing a substantially non-explosive powder containing finely divided metallic particles suitable for being incorporated in a refractory mixture, comprising simultaneously grinding a mixture of pieces of metal with pieces of an inert refractory material to produce a premixture containing finely divided metallic particles and finely divided refractory particles which are intimately mixed together. The refractory particles are present in such particle sizes and quantities as ensure that the Minimum Explosible Concentration, as tested in a 20-L vessel with a chemical igniter, is greater than 100 gm/m$^3$. The inert particles comprise at least 40% of the mixture, and preferably 50% to 75%. The invention also includes a premixed powder, produced by this process, especially as contained in drums or impermeable bags.

16 Claims, 2 Drawing Sheets

PRODUCTION OF NON-EXPLOSIVE FINE METALLIC POWDERS

FIELD OF THE INVENTION

1. Background of the Invention

This invention relates to non-explosive fine metallic powders and a process for their production for subsequent use as a raw material component in the production of high temperature refractory materials.

2. Prior Art

In recent years, it has become the practice for certain refractory materials, especially those used for lining liquid metal containers, to be formed from a mixture containing particles of aluminum or magnesium metal and/or alloys thereof, in addition to the usual refractory materials and binders. Calcium alloys have also been suggested for this purpose. The metal particles react during firing of the refractory mixture to form oxides or other compounds. Examples of processes for making refractories using such metal particles are given in the following patents:

U.S. Pat. No. 3,322,551 (Bowman)
U.S. Pat. No. 4,069,060 (Hayashi et al.)
U.S. Pat. No. 4,078,599 (Makiguchi et al.)
U.S. Pat. No. 4,222,782 (Alliegro)
U.S. Pat. No. 4,243,621 (Mori et al.)
U.S. Pat. No. 4,280,844 (Shikano et al.)
U.S. Pat. No. 4,460,528 (Petrak et al.)
U.S. Pat. No. 4,306,030 (Watanabe et al.)
U.S. Pat. No. 4,460,528 (Petrak et al.)
U.S. Pat. No. 4,557,884 (Petrak et al.)

In making the refractories by the methods described in the aforesaid patents, it is generally considered advantageous to use very fine metallic particles. U.S. Pat. No. 4,078,599 suggests that a suitable particle size for the aluminum powder is smaller than 200 mesh (74 microns), whereas U.S. Pat. No. 4,222,782 suggests particle sizes of 4.5 microns and 4.0 microns which is smaller than 400 mesh. This has led to a demand for metal producers to sell metallic powders having very small particle sizes of this order. However, very fine metallic powders pose an explosion hazard, since they are subject to dusting in which situation an explosion can easily occur if there is a spark or some ignition source. This makes it difficult to produce, package, ship and handle such fine metallic powders while ensuring safety from explosions and fires.

While finely distributed metallic powders as described above are desirable, many metal powder producers and refractory manufacturers choose not to produce or use such fine powders because of the related explosion hazards. For this reason, many refractory manufacturers sacrifice refractory performance for safety by using substantially coarser metallic powders which may contain up to 50% of the fraction between +35 mesh, −100 mesh (+420, −150 microns). The object of the present invention is to supply finely divided metallic powders with a particle size distribution that provides optimum performance in the final refractory product with substantially reduced explosivity risk during production, packaging, shipping, handling and storage of said metallic powders.

SUMMARY OF THE INVENTION

In accordance with one aspect of the present invention, finely divided metallic powders such as but not exclusively aluminum, magnesium or alloys of aluminum, magnesium or calcium, are blended with inert material to render them relatively or substantially non-explosive as compared to the unblended metallic powders. The preferred inert materials are those that can be usefully incorporated into the final refractory product such as, but not necessarily, calcined dolomite, burnt magnesite and/or alumina. It has been found that premixed powders of this type can be safely stored, packaged, transported and handled without serious risk of explosion or fire and hence are suitable for safe use by refractory manufacturers. The amount of inert material which needs to be included is often very much less than is required in the final refractory product.

A second aspect of the present invention is a method for the safe production of said finely divided metallic alloys. Preferably, the finely divided metallic powder and the inert substance are produced simultaneously by grinding together larger pieces of the metal or alloy and inert material. In this way, the finely divided metal powders are never without an admixture of inert material, and thus reduce the explosion hazard during their production. Grinding may also be conducted under inert gas such as argon or nitrogen to further reduce the risk of explosion.

The simultaneous grinding of metals or alloys and inert material is functional when the metallic constituent is sufficiently brittle to be ground by conventional comminution technology such as in a ball mill, rod mill, hammer mill, hogging mill or the like. In these cases, the metallic portion of the feedstock to the grinding mill is blended with the correct proportion of the inert material for simultaneous grinding to the desired screen size distribution of the final metallic blended powder. The metallic feed to the grinding mill may be in the form of pieces such as ingots, chunks, granules, machined turnings or chips and the like which may be produced by a preliminary casting, crushing or machining process. Because of their coarser size distribution, these metallic feed materials are considerably less explosive and much safer to handle than the finely divided metallic powders required for refractory applications. The inert material feed may also be in the form of pieces such as briquettes or granules larger than the final particle size; or may be preground powder suitable for refractory manufacture. Simultaneous grinding as described above can be applied to the production of finely divided magnesium metal, aluminum metal, magnesium-aluminum alloys, magnesium-calcium alloys, calcium-aluminum alloys and the like. This simultaneous grinding produces a ground mixture which serves as a premixture for making refractories.

In some instances, finely divided metallic powders are produced directly from liquid metals and alloys by an atomization process. In this case, grinding may not be needed to produce the final metallic powder size distribution. However, the present invention is still beneficial in these instances since blending of the atomized metal powders with the correct proportion of inert material will still render the mixture substantially non-explosive and hence safe for subsequent processing, packaging, shipping, handling and storage. Examples of this would be blending of inert materials with atomized aluminum metal, magnesium metal and the like. In cases where the metallic powder is produced separately from production of inert material it can if necessary be inhibited from explosion by the use of inert gas, until mixed with the inert refractory powder.

In accordance with another aspect of the invention, a process for making a refractory which incorporates aluminum or magnesium compounds, comprises:

producing a relatively non-explosive ground premixture of finely divided metallic powder and a finely divided inert material suitable for use in the refractory, said producing step being carried out under conditions in which explosion of the metal powder is inhibited by the use of inert material, and in some cases in combination with inert gas shrouding;

packaging and transporting said relatively non-explosive premixture to a location at which the refractory is to be made; and combining said premixture with other materials including a binder, and forming the refractory from the combined mixture.

The explosivity of the premixture in accordance with this invention depends on the fineness of both the metallic powder and the inert material, and on the amount of inert material in the premixture. The amount and sizing of the inert material may be chosen to make the premixture entirely non-explosive in air. Alternatively, the inert material may just be enough to ensure that the premixture of fine metallic powder and inert material is at least as non-explosive as coarse metallic powders presently marketed for refractory mixes, such as metallic powders having say 30% of −100 mesh particles. As will be explained more fully below, a suitable standard would be that the Minimum Explosible Concentration (MEC), as tested in a 20-L vessel with a chemical igniter, should be greater than 100 gm/m$^3$. Depending on the fineness of the metallic particles and the inert particles, this result may be achieved with only about 40% of the premixture comprising the inert material. Preferably however, sufficient inert material should be used to ensure that the MEC is greater than 200 gm/m$^3$.

However, it may be desirable to make the premixture effectively non-explosive, for which purpose the inert material should have a screen size which is 80% −100 mesh or smaller, and should be present in a proportion of at least 60% and preferably about 75%.

All references to percentage compositions herein are by weight.

Although, prior to this invention, fine metallic powders have been mixed with refractory powders as a part of the process for making refractories, it is not believed that any such mixtures have been packaged for sale or transport. Accordingly, a further novel aspect of this invention is a novel combination comprising a shipping container and, contained therein, a premixture of finely divided metallic powder and finely divided inert refractory material suitable for use in making a refractory, the amount and fineness of the inert material being sufficient to render the premixture substantially non-explosive and, at least, safe for normal shipping and handling. Suitable shipping containers include metal drums, preferably having plastic liners, and so-called "supersacks" which are large bags woven of synthetic material, and having an impervious (e.g. plastic) liners. The packaging for the premixture has to be designed to avoid hydration, but prevention of explosion is not a consideration. By contrast, fine metal powders now have to be shipped in steel drums, by regulations, in view of the explosion hazard.

BRIEF DESCRIPTION OF THE DRAWINGS

The invention will be described with reference to the following drawings, in which.

DETAILED DESCRIPTION

Figure 1:
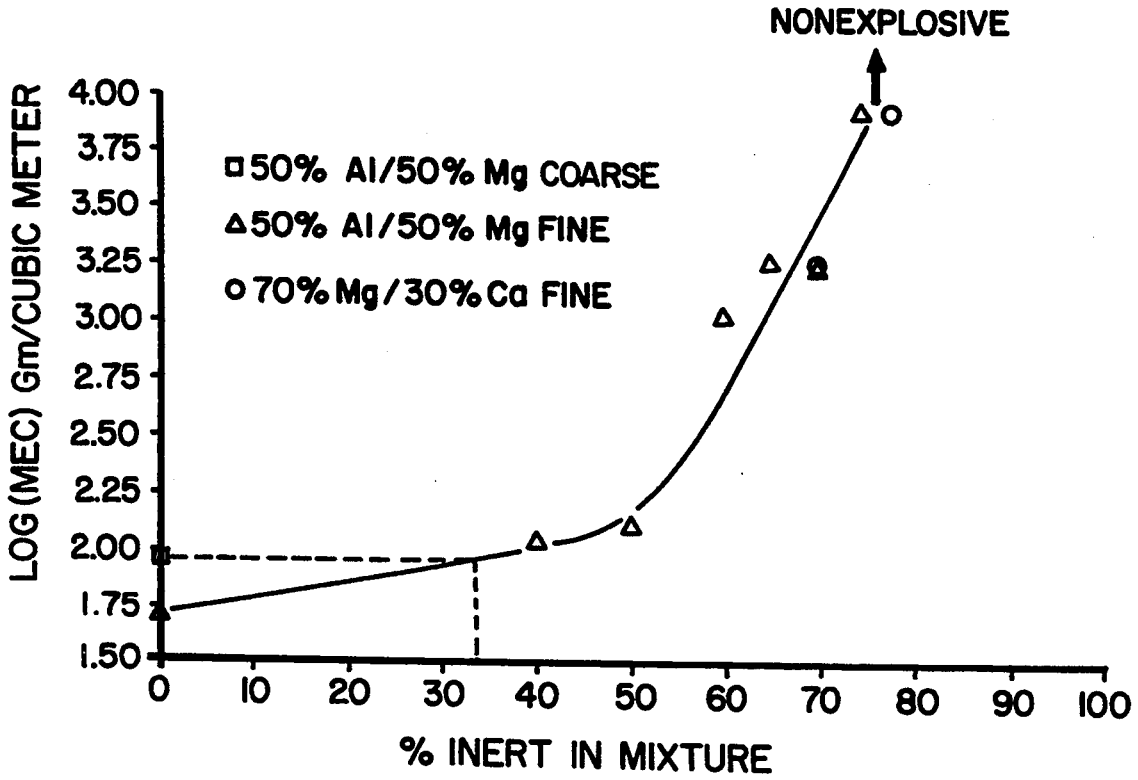
FIG. 1 is a graph showing the logarithm of the MEC (Minimum Explosible Concentration) against percentage inert material in the premixture.

A preferred process for preparing a raw material for refractory production will now be described.

The metallic portion of the raw material product can be in the form of ingots and the like or partially comminuted chunks, granules, chips, turnings and the like obtained by suitable crushing or machining processes known to people skilled in the art.

Said metallic portion is charged to a suitable grinding mill in combination with the desired proportion of inert material. The inert material may be any oxide or blend of oxides which are compatible with the final refractory product, for example, calcined or burnt magnesite which consists principally of magnesia (MgO), calcined dolomite which consists principally of a chemical blend of lime (CaO) and magnesia (MgO), calcined bauxite, alumina ($Al_2O_3$), which consists principally of aluminum oxide, silica ($SiO_2$), and other such suitable oxides. The inert materials may contain impurities which are acceptable to the final refractory product such as lime (CaO) and silica ($SiO_2$). These inert materials may be in the form of chunks, briquettes, pieces, preground fines and the like.

The blended metallic and inert materials are simultaneously and progressively reduced in size in a suitable milling device such as a ball mill, rod mill, hammer mill, hogging mill and the like. The grinding should be such as to reduce the particle size of the majority (at least 50%) of the metallic alloy to less than 35 mesh (400 microns) and preferably less than about 100 mesh (150 microns). The particle size of the inert material should preferably be less than 65 mesh. It is important to adjust the particle size so that a majority (at least 50%) of the inert material is less than 65 mesh; if the premixture contains 75% of inert particles of −65 mesh it will be substantially non-explosive. It is also important to adjust the particle size of the inert material so that it is fine enough to substantially reduce the explosivity of the mixture and is compatible with the size distribution requirements of the refractory blend mixture. This can be accomplished in the present invention by adjusting the size distribution of the inert material charged to the mill and length of grinding time. In cases where added protection from explosion is required, grinding may be conducted under an inert gas shroud such as argon or nitrogen.

The proportion of inert oxide in the mixture is more than about 40%, preferably more than 50%, and most desirably more than about 70%. It is chosen to be such that, at a minimum, the mixture of fine metallic powder and inert material is not more explosive than the coarse pure unblended metallic powder typically used for refractory applications and hence refractory manufacturers obtain the benefits of fine metallic powder in a substantially safer form. The explosiveness of a mixture of metallic powder and inert material depends on both their relative proportions in the mixture and their respective fineness; criteria for choosing the proper proportions and fineness of materials are discussed below and supported by appropriate examples.

Since the premixed fine metallic and inert refractory powders can be made substantially non-explosive, they can be handled, packaged and shipped to the point at which the refractory is to be made without taking precautions against explosions. When received by the refractory maker, the premixed metallic and inert oxide powders are mixed in with other refractory materials, as necessary, and with binders, and can be formed into refractories in the usual way.

The patents listed above give some examples of how metallic powders and burnt magnesite can be used for making refractories.

For example, U.S. Pat. No. 3,322,551 describes a process in which finely divided aluminum or magnesium is incorporated into a refractory mix containing basic or non-acid calcined (burnt) oxide refractory grains such as periclase, magnesite, chromite, dolomite and the like, bonded together by cokeable, carbonaceous bonding agents such as tar or pitch. Such refractories are widely used as linings for basic oxygen steel converters.

This '551 patent suggest the following mixture (as specimen A-2) for making refractory bricks:

- 71 parts by weight of deadburned magnesite, comprising 81% MgO, 12% CaO, 5% $SiO_2$, balance impurities;
- 24.8 parts of periclase having over 98% MgO;
- 3.5 parts of pulverized pitch having a softening point of 300°-320° F.;
- 1.2 parts neutral oil (a light oil from which all the naphthalene has been removed); and
- 1 part by weight magnesium powder of less than 100 mesh size.

If it were desired to make a similar composition using the non-explosive powder mixture of this invention, and having 25% magnesium metal powder mixed with 75% of deadburned magnesite, the mixture could be as follows:

- 68 parts of deadburned magnesite;
- 24 parts of periclase;
- 3.5 parts of pulverized pitch;
- 1.2 parts neutral oil; and
- 4 parts of the non-explosive mixture containing 1 part of magnesium and 3 parts of burned magnesite.

It would of course be theoretically possible to provide the metallic powder premixed with all of the inert refractory material, i.e. all of the deadburned magnesite and periclase. However, this would give a mixture containing well over 95% of inert refractory material, and it would not normally be economical to have all of this material transported from the metal producer. It is desirable from the point of view of economics that the refractory particles are not more than 90% of the total mixture. Hereinafter there are set out criteria for determining what proportion of inert material needs to be included in the mixture to ensure that this is wholly or relatively non-explosive.

U.S. Pat. No. 3,322,551 also sets out mixtures which can be used for making refractories and which contain pulverized aluminum. In fact, a refractory can be made using the same proportions as set out above, except for using aluminum or aluminum-magnesium alloys in place of magnesium. Many of the other patents listed above give examples of refractory mixtures which can be used containing aluminum, and in which the inert refractory material is alumina. These include U.S. Pat. Nos. 4,078,599, 4,222,782 and 4,243,621. U.S. Pat. Nos. 4,460,528 and 4,557,884 are concerned with refractory compositions including aluminum metal and silica; accordingly a non-explosive mixture of aluminum metals and alloys and silica and/or alumina could be used to produce refractories in accordance with these patents.

EXPERIMENTAL RESULTS—EXPLOSIBILITY OF POWDERS

To avoid high shipping costs involved in using large amounts of refractory powder, experiments have been done to determine the amount of inert refractory material needed to render finely divided metallic powders either relatively non-explosive or completely non-explosive.

The experiments were done using a variety of metallic alloys including aluminum-magnesium alloys, magnesium-calcium alloys and a strontium-magnesium-aluminum alloy. The alloy powder was premixed with different proportions of burnt magnesite (MgO) as indicated in Table 1 below. The table sets out the proportion of powders and magnesite by weight. Two sizes of magnesite particles were used, firstly a coarse size of less than 65 mesh (200 microns) and secondly a fine size of less than 100 mesh (150 microns). Explosion tests were carried out to determine the Minimum Explosible Concentration (MEC) and in some cases Minimum Oxygen Concentration (MOC) for the various mixtures. The MEC is the least amount of the dust dispersed homogeneously in air which can result in a propagating explosion. Lesser quantities may burn momentarily after being exposed to an ignition source, but no explosion will result. An alternative means of prevention of explosions is to use an inert gas, such as nitrogen, in the space occupied by the dust cloud. To determine the quantity of inert gas required, the MOC was measured for four of the alloy/burnt magnesite samples.

The explosion tests were carried out in a 20-L vessel designed by the U.S. Bureau of Mines with minor modifications. The consensus by experts in dust explosions is that 20-L is the minimum size of vessel that can be used to determine the explosibility of dusts. Dust explosion experts also concur that a strong igniter, such as the 5-kJ Sobbe chemical igniter, is required for the determination of the MEC. Use of a continuous electrical discharge, as was formerly used, can indicate that a dust is not explosible when indeed it is. All the explosion tests used for the determination of the MEC in these experiments used the 5-kJ Sobbe igniter.

For each test, a weighed amount of dust was placed into the sample holder at the base of the vessel, the igniter was placed in the centre of the vessel, the vessel was closed and then evacuated. A 16-L pressure vessel was filled with dry air at 1100 kPa and the trigger on the control panel was pressed to start the test. A solenoid valve located between the 16-L vessel and the dust chamber opened for a preset time, usually about 350 ms, which allowed the air to entrain the dust and form a reasonably homogeneous dust cloud in the 20-L vessel at a pressure of one atmosphere absolute. After another preset time, usually about 100 ms, the igniter fired. The entire pressure history of the test was captured on a Nicolet* 4094 digital oscilloscope. After the combustion gases had cooled, they were passed through a Taylor Servomex* paramagnetic oxygen analyzer, from which the percentage of oxygen consumed was calculated. A fine-gauge thermocouple is installed inside the vessel, and its output was also recorded by the oscilloscope. Although a thermocouple cannot be expected to measure the actual temperature of the flame front during the explosion, it provides useful confirmation of the existence of the explosion.

The Sobbe igniter itself generates a significant pressure (about 50 kPa for the 5-kJ igniter). This was taken into account by subtracting the pressure curve of the igniter from the experimental pressure trace. The rate of pressure rise $(dP/dt)_m$, was determined from the derivative curve, generated numerically by the oscilloscope.

For the MOC determinations, a mixture of dry nitrogen and dry air was prepared in the 16-L air tank, using partial pressures. The actual concentration of these mixtures was measured by flowing a small amount through the oxygen analyzer. The measured value was always close to the calculated value.

Table 1 below sets out the results obtained, for various proportions of inert refractory MgO powder (given in terms of percentages by weight of alloy and MgO), for fine (−100 mesh) and coarse (−65 mesh) refractory. Both for MEC and MOC, the higher numbers indicate a low explosibility of the mixture.

TABLE 1

| Description of Dust | | | | | | |
|---|---|---|---|---|---|---|
| Metallic | % in Mixture | Size (mesh) | % Inert* in Mixture | Size (mesh) | MEC (gm/m³) | MOC (% $O_2$) |
| 50% Al-50% Mg | 100 | 30%, −100 | 0 | — | 90 ± 15 | 8.9 ± 0.3 |
| 50% Al-50% Mg | 100 | 82%, −100 | 0 | — | 52 ± 4 | 7.3 ± 0.2 |
| 50% Al-50% Mg | 60 | 82%, −100 | 40 | 82%, −100 | 110 ± 10 | — |
| 50% Al-50% Mg | 50 | 82%, −100 | 50 | 82%, −100 | 130 ± 10 | 12.4 ± 0.2 |
| 50% Al-50% Mg | 40 | 82%, −100 | 60 | 82%, −100 | 1000 ± 100 | — |
| 50% Al-50% Mg | 35 | 82%, −100 | 65 | 82%, −100 | 1750 ± 250 | — |
| 50% Al-50% Mg | 30 | 82%, −100 | 70 | 82%, −100 | 1600 ± 200 | 17.8 ± 0.2 |
| 50% Al-50% Mg | 25 | 82%, −100 | 75 | 82%, −100 | nonexplosive | — |
| 50% Al-50% Mg | 25 | 82%, −100 | 75 | 97%, −65 +100 | 1500 ± 50 | — |
| 45% Sr-25% Mg-35% Al | 100 | 20%, −100 | 0 | — | 120 | — |
| 70% Mg-30% Ca | 30 | 82%, −100 | 70 | 82%, −100 | 1700 ± 100 | — |
| 70% Mg-30% Ca | 25 | 82%, −100 | 75 | 82%, −100 | nonexplosive | — |

*burnt magnesite (MgO)

The explosivity data in Table 1 relating to the 50% Al-50% Mg metallic powders blended with varying amounts of burnt magnesite are shown in FIG. 1 and indicate the following:

1) The MEC for pure, unblended metallic powders decreases with increasing fineness of powder. For example, a coarse 50% Al-50% Mg powder containing 30%, −100 mesh (150 microns) is explosive if the dust cloud contains at least 90±15 gm/m³. Increasing the fineness of the powder to 82%, −100 mesh substantially increases explosivity with a dust cloud containing only 52±4 gm/m³ now being explosive. Because of safety concerns, many refractory producers sacrifice refractory performance properties by utilizing coarser metallic powders (typically containing no more than 50% −100 mesh)instead of the more desirable finer, but more highly explosive, powders. If sufficient refractory particles, of small mesh size, are used to ensure that the MEC is about 100 gm/m³, then the mixture of metallic particles and inert material will be at least as safe to use as the standard unblended coarse metallic powders. If the MEC of the premixture is increased to 200 gm/m³, it will be much safer than the standard coarse metallic powder.
2) The MEC increases exponentially with an increasing proportion of inert material in the metallic-inert blend. For example, a 50% fine magnesite powder—50% fine metallic powder blend has a MEC of 130±10 gm/m³. As such this 50/50 blend is 2.5 times less explosive than unblended fine alloy powder and 1.4 times less explosive than unblended coarse alloy powder. By 60% fine magnesite in the blend, the mixture is substantially non-explosive, and at 75% the mixture is entirely non-explosive. This exponential relationship is surprising since it indicates that the mechanism for rendering the mixture less explosive is not one of pure dilution of the metallic portion since, in the case of dilution, a linear one for one relationship between the MEC and percent burnt magnesite in the blend would be expected. The results indicate there is some threshold point beyond which the explosivity of the mixture diminishes rapidly.
3) FIG. 1 shows that a blend containing about 35% magnesite with 65% fine metallic powder is approximately as explosive as the unblended pure coarse metallic powder typically used in a refractory manufacture. By increasing the magnesite content of the blend to 55%, the explosivity of the mixture is approximately one half that of pure unblended coarse metallic powder.
4) The fineness of the inert material also plays a role in the explosivity of the blend. Whereas blends of 75% fine magnesite—25% fine metallic (both 82%; −100 mesh) are non-explosive, a similar mixture made up with 75% coarse magnesite (97%; −65+100 mesh) will explode provided the dust cloud contains 1,500±50 gm/m³or more. However, a mixture in which say 70% of the total mix is less than 65 mesh can be considered relatively non-explosive compared to unblended coarse metallic particles.
5) For the two alloy systems tested, Al-Mg and Mg-Ca, it appears the relationship between explosivity and percentage inert in the mixture is similar.

The results for MEC can also be presented in terms of Relative Explosibility, i.e. explosivity as compared to an unblended coarse (50% AL-5% Mg) powder containing 30% −mesh, having MEC of 90. The results are shown in Table 2 below;

TABLE 2

| Blend | | |
|---|---|---|
| Fine Alloy Powder | Magnesite | Relative Explosivity* |
| 100% | 0 | 1.73 |
| 60% | 40% | 0.82 |
| 50% | 50% | 0.69 |

TABLE 2-continued

| Blend | | |
|---|---|---|
| Fine Alloy Powder | Magnesite | Relative Explosivity* |
| 40% | 60% | 0.09 |
| 35% | 65% | 0.051 |
| 30% | 70% | 0.056 |
| 25% | 75% | nonexplosive |

*compared to unblended coarse alloy powder

Figure 2:
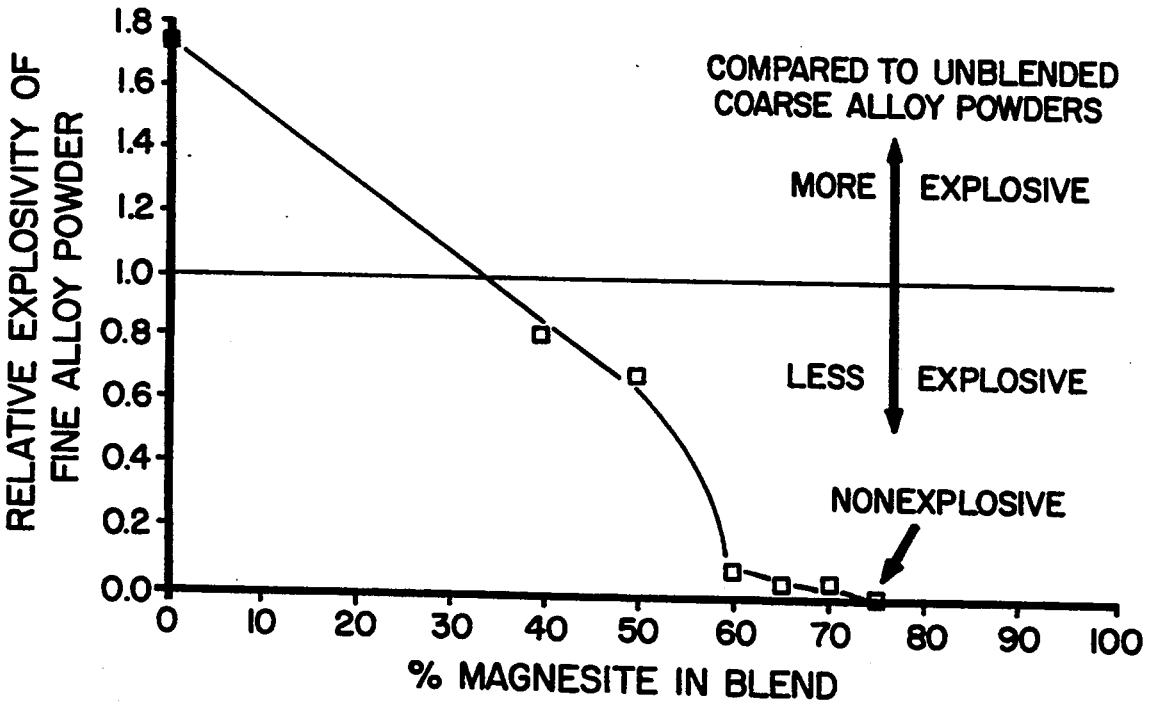
FIG. 2 is a graph showing relative explosivity of the premixture, compared to an unblended coarse alloy powder, plotted against percentage magnesite in the premixture.

Table 2 and FIG. 2 shows that:

1) pure unblended fine alloy powder is 1.73 times more explosive than the pure unblended coarse alloy (a MEC of 52 compared to 90);
2) fine alloy powder blended with about 35% magnesite has a Relative Explosivity equal to 1. This indicates that the explosivity of the fine alloy powder has been reduced by blending with 35% magnesite to a value equivalent to pure unblended coarse alloy powder;
3) by increasing the proportion of magnesite in the blend, the fine alloy powder becomes progressively more inert compared to unblended coarse alloy powder. With 60% magnesite, the mixture is highly inert and at 75% magnesite it is non-explosive.

The above experimental data illustrate the important relationships which must be considered when setting out to reduce the explosiveness of a metallic powder by blending with an inert material. A proper blend can be safely handled, packaged, shipped and stored with a substantially lower risk of explosion than pure metallic powder.

The examples below illustrate a process for producing fine metallic powders with reduced risk of explosion by simultaneously and progressively reducing the size of a blend of metallics and inert material in a suitable milling device such as a ball mill, rod mill, hammer mill, hogging mill and the like.

EXAMPLE 1

A rotating ball mill containing 1,683 kg of balls was charged with a 500 kg mixture containing 75% by weight −2,000 microns burnt magnesite and 25% by weight −13 mm (½ inch) 50% Al-50% Mg alloy. Prior to charging to the ball mill, the alloy had been prepared by simultaneous melting of magnesium and aluminum metals in the desired proportions in a suitably designed melt pot. The molten alloy was cast as ingots and subsequently crushed to −13 mm in a jaw crusher.

This mixture of magnesite and metallics was simultaneously ground in the mill for 1 hour. A sample the inert material, metallic powder mixture was taken from the mill yielding a blended product of 64% −100 mesh. An analysis of the mixture showed the metallic portion was 72%, −100 mesh with an average particle size of 111.4 microns. The burnt magnesite fraction was 62%, −100 mesh having an average particle size of 136.0 microns.

EXAMPLE 2

The material in example 1 was further ball milled for an additional hour (total 2 hours) and sampled. The mixture was now finer measuring 85%, −100 mesh with the metallic portion being 90%, −100 mesh and the magnesite 83%, −100 mesh. Average metallic and magnesite particle sizes were 74.8 microns and 84.9 microns, respectively.

EXAMPLE 3

The material in example 2 was further ball milled for an additional hour (total 3 hours) and sampled. After 23 hours, the blend was 91%, −100 mesh with the metallic portion being 93%, −100 mesh and the magnesite being 90%, −100 mesh. The average particle size was 71.0 microns for the metallic fraction and 74.9 microns for the magnesite.

EXAMPLE 4

A 400 kg mixture containing 75% by weight fine magnesite (55%, −43 microns) and 25% by weight −13 mm crushed 50% Al-50% Mg alloy was charged to a ball mill containing 983 kg of balls. After 1 hour and 15 minutes of grinding, the blended material inside the mill was sampled. The blend was 92%, −100 mesh with the metallic portion being only 82%, −100 mesh and the magnesite being 96%, −100 mesh. The average particle size in the blend was 99.6 microns for the metallic powder and 68.2 microns for the inert material.

EXAMPLE 5

The material in example 4 was ground for an additional 30 minutes (1 hour and 45 minutes total) and sampled. The blend was 95%, −100 mesh with the metallic fraction being 91%, −100 mesh and the magnesite 96%, −100 mesh. The average metallic and magnesite particle sizes were 85.7 microns and 69.5 microns respectively.

EXAMPLE 6

Approximately 375 kg of coarse magnesite briquettes −25.4 mm was charged to a ball mill containing 750 kg of balls. After 15 minutes of grinding, the magnesite was reduced in size with 23%, −100 mesh. A further 15 minutes increased the −100 mesh portion to 55%. At this point, 125 kg of precrushed 50% Al-50% Mg alloy was charged to the mill and the mixture was ground simultaneously. The following screen size distribution was obtained at various grinding times:

| Grinding Time Min. | Screen Size of Blend % −100 mesh |
|---|---|
| 30 | 68% |
| 60 | 79% |
| 90 | 87% |

A second similar test produced 90% of the mixture being −100 mesh after a similar grinding time.

Figure 3:
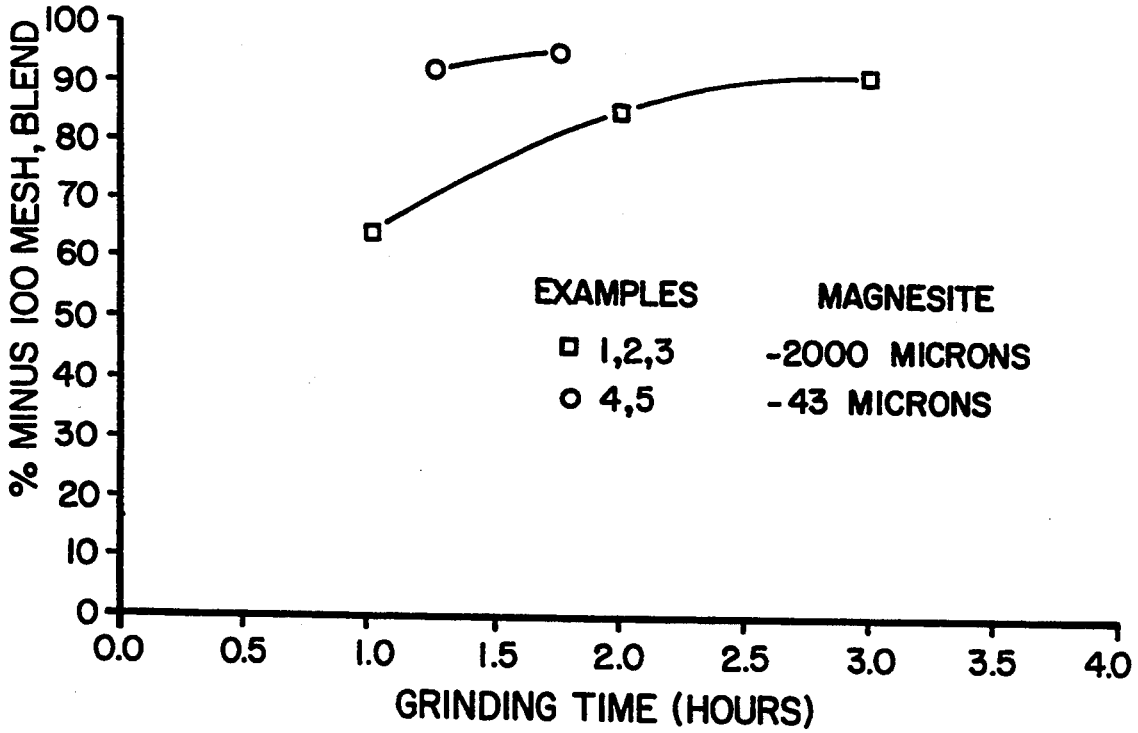
FIG. 3 is a graph showing how the fineness achieved for the premixture particles varies with grinding time.

FIG. 3 illustrates that the −100 mesh proportion of the blend can be increased by lengthening the grinding time. Conversely, grinding time can be shortened by introducing finer inert material into the mill.

Figure 4:
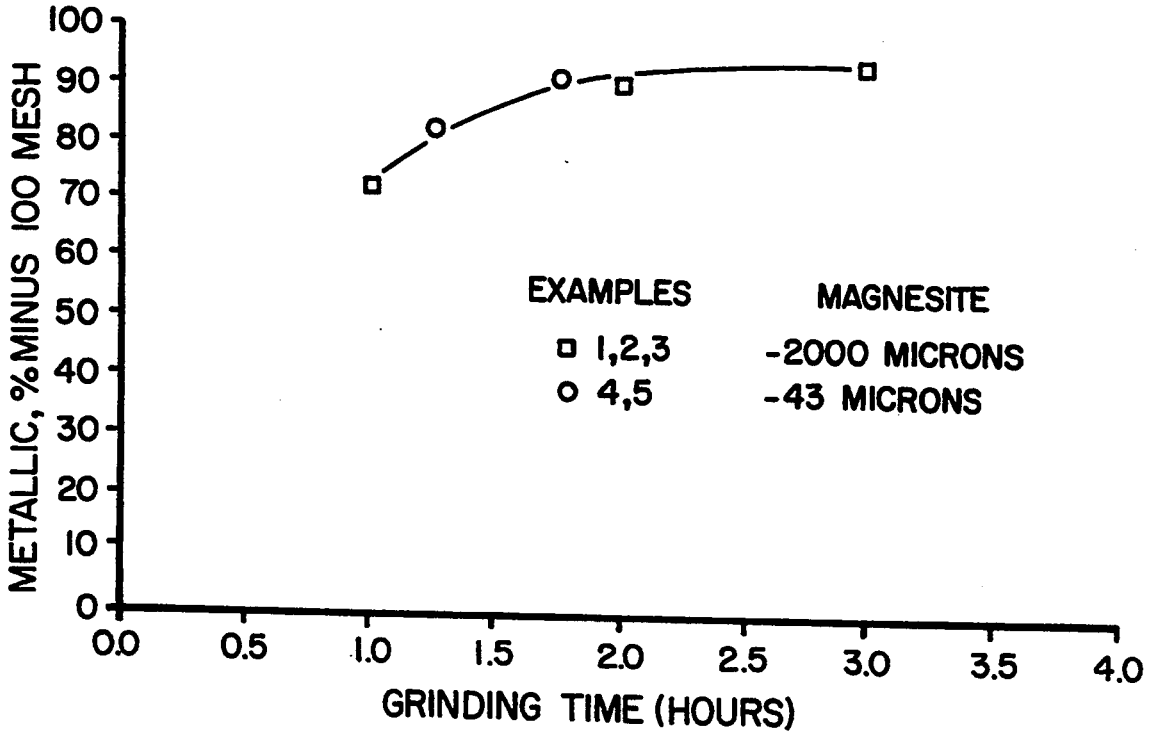
FIG. 4 is a graph showing how the fineness achieved for the metallic particles varies with grinding time.

FIG. 4 illustrates that the −100 mesh proportion of the metallic portion of the blend also increases with grinding time. The resulting fineness of the metallics appears relatively unaffected by the initial fineness of the burnt magnesite charged to the mill.

These examples illustrate how the final screen size distribution of both the inert and metallic fractions can be influenced by mill operating parameters such as:

screen size of the respective charge materials to the mill
weight of the grinding media
grinding time By controlling these operating parameters, it is possible to produce a blended product which is both substantially non-explosive and satisfies the screen size distribution for the materials of refractory manufacture.

We claim:

1. A process for producing a substantially non-explosive powder containing finely divided particles of metal selected from the group consisting of aluminum, magnesium, or alloys of aluminum, magnesium or calcium, comprising simultaneously grinding a mixture of pieces of said metal with pieces of a refractory material to produce a ground mixture containing finely divided metallic particles, at least 50% of which are less than 100 mesh, and finely divided refractory particles said metallic and refractory particles being intimately mixed together, said refractory particles constituting between 40% and 90% of the said ground mixture and having 50% of the refractory material less than 65 mesh, and being present in such particle sizes and quantities as ensure that the Minimum Explosible Concentration, as tested in a 20-L vessel with a chemical igniter, is greater than 100 gm/m$^3$.

2. A process according to claim 1, wherein the refractory particles are present in such particle sizes and quantities as ensure that the Minimum Explosible Concentration, as tested in a 20-L vessel with a chemical igniter, is greater than 200 gm/m$^3$.

3. A process according to claim 1, wherein said metallic particles include at least 80% of particles of less than 100 mesh.

4. A process according to claim 1, wherein the refractory material constitutes at least 50% of the total ground mixture.

5. A process according to claim 1, wherein the refractory material constitutes between 60% and 90% of the total ground mixture.

6. A process according to claim 5, wherein the refractory material constitutes between 75% and 90% of the total ground mixture.

7. A process according to claim 1, wherein the ground mixture contains at least 70% of refractory particles of less than 65 mesh.

8. A process according to claim 1, wherein said refractory material includes magnesia, alumina, and/or silica.

9. A process for making a refractory which utilizes aluminum and/or metal powder, or alloys thereof, comprising:

producing a ground mixture of finely divided metallic particles of aluminum, magnesium or alloys of aluminum, magnesium or calcium and finely divided refractory material having particles at least 50% of which are less than 100 mesh, said refractory material constituting between 40% and 90% of the said mixture and having 50% thereof less than 100 mesh and being present in such particle sizes and quantities as ensure that the Minimum Explosible Concentration is greater than 100 gm/m$^3$;

packaging and transporting said mixture from the location at which it is produced to a location at which a refractory is to be made;

unpackaging the mixture at said location; and combining said non-explosure mixture with further refractory material and binder, and forming the refractory.

10. A process according to claim 9, wherein said refractory material is present in such quantities and particle sizes as to render the said mixture substantially non-explosive.

11. A process according to claim 9, wherein said refractory material comprises magnesia, alumina, and/or silica.

12. A process according to claim 7, wherein the ground mixture contains metallic particles of which at least 80% are of less than 100 mesh.

13. A process according to claim 9, wherein the ground mixture contains metallic particles of which at least 80% are of less than 100 mesh.

14. A process according to claim 9, wherein at least 80% of said refractory particles are less than 100 mesh.

15. A process according to claim 1, wherein said refractory material includes calcined dolomite.

16. A process according to claim 9, wherein said refractory material includes calcined dolomite.

* * * * *